US008992759B1

(12) United States Patent
Silinger et al.

(10) Patent No.: US 8,992,759 B1
(45) Date of Patent: Mar. 31, 2015

(54) METAL REFINING PROCESS USING MIXED ELECTROLYTE

(71) Applicant: Honeywell International Inc., Morristown, NJ (US)

(72) Inventors: Paul P. Silinger, Post Falls, ID (US); Brett M. Clark, Spokane Valley, WA (US); Mark B. Fery, Spokane, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 14/185,341

(22) Filed: Feb. 20, 2014

(51) Int. Cl.

| | |
|---|---|
| ***C25D 1/14*** | (2006.01) |
| ***C25C 3/30*** | (2006.01) |
| ***C25C 1/14*** | (2006.01) |
| ***C25D 3/30*** | (2006.01) |

(52) U.S. Cl.
CPC .... *C25C 1/14* (2013.01); *C25D 3/30* (2013.01)
USPC ..... 205/610; 205/300

(58) Field of Classification Search
CPC ..... C25D 3/30; C25C 1/14
USPC ..... 205/300, 610
See application file for complete search history.

(56) References Cited

U.S. PATENT DOCUMENTS

| | | | | |
|---|---|---|---|---|
| 1,466,126 | A * | 8/1923 | Fink | 205/300 |
| 3,293,026 | A | 12/1966 | Forward et al. | |
| 4,330,377 | A | 5/1982 | Franks, Jr. | |
| 8,303,792 | B1 * | 11/2012 | Schreiber et al. | 205/122 |
| 2009/0098012 | A1 | 4/2009 | Shindo et al. | |
| 2010/0137970 | A1 * | 6/2010 | Srivastava et al. | 623/1.15 |
| 2012/0298586 | A1 | 11/2012 | Grandbois et al. | |
| 2013/0028786 | A1 | 1/2013 | Kanou | |
| 2013/0341196 | A1 | 12/2013 | Silinger et al. | |

FOREIGN PATENT DOCUMENTS

| | | | |
|---|---|---|---|
| CN | 1114985 | A | 1/1996 |
| GB | 191220557 | A | 7/1913 |
| GB | 240147 | A | 10/1926 |
| GB | 254284 | A | 11/1927 |
| JP | H01283398 | A | 11/1989 |
| JP | H02228487 | A | 9/1990 |
| JP | H11343590 | A | 12/1999 |
| JP | 2003183871 | A | 7/2003 |
| JP | 2005264252 | A | 9/2005 |
| JP | 2006083457 | A | 3/2006 |
| JP | 2012087407 | A | 5/2012 |
| JP | 2012218955 | A | 11/2012 |

(Continued)

OTHER PUBLICATIONS

Kekesi, Tamas "Electrorefining in Aqueous Chloride Media for Recovering Tin From Waste Materials", Acta Metallurgica Slovaca, vol. 19, 2013, No. 3, p. 196-205.

(Continued)

*Primary Examiner* — Edna Wong
(74) *Attorney, Agent, or Firm* — Faegre Baker Daniels LLP

(57) ABSTRACT

An electrorefining process is disclosed for producing high purity tin having reduced short-term and long-term alpha particle emissions and reduced lead levels. The process may use a mixed acidic electrolytic solution including at least a first electrolyte that provides sulfate ions in the mixed electrolytic solution, such as sulfuric acid, and a second electrolyte that provides halide ions in the mixed electrolytic solution, such as hydrochloric acid.

10 Claims, 2 Drawing Sheets

(56) References Cited

FOREIGN PATENT DOCUMENTS

| | | | |
|---|---|---|---|
| KR | 101252137 | B1 | 4/2013 |
| WO | W08201198 | A1 | 4/1982 |

OTHER PUBLICATIONS

Rimaszeki, G. et al., "Investigation and Optimization of Tin Electrorefining in Hydrochloric Acid Solutions", J Appl Electrochem (2012) 42:573-584.

Clark, Brett M., "The Distribution and Transport of Alpha Activity in Tin", Copyright 2012 Honeywell International Inc., 13 pages.

Rimaszeki, Gergo et al., "The Examination of the Stability of Hydrochloric Acid—Tin Chloride Electrolyte Applied for Tin Electrorefining", Department of Metallurgical and Foundry Engineering, University of Miskolc.

Low, C.T.J. et al., "Electrochemistry of Tin Deposition From Mixed Sulphate and Methanesulphonate Electrolyte", Transactions of the IMF, vol. 86, Issue 3 (May 1, 2008), pp. 148-152 (Abstract only).

Dobo, Zsolt et al., "Electrorefining of Tin in Pure Acid Solutions by Mechanically Controlled Cathode Deposition and Solar Power Utilization", Materials Science and Engineering, vol. 37/2 (2012), pp. 19-26.

Brochure entitled "Low Alpha Tin, Ultra Low Alpha Tin, and Super Ultra Low Alpha Tin" Pure Technologies, dated Nov. 25, 2013, 10 pages.

Rimaszeki, Gergo et al., "The Efficiency and Morphological Characteristic of the Electrorefining of Tin in Simple Sulfuric and Hydrochloric Acid Solutions", Department of Metallurgical and Foundry Engineering, University of Miskolc, available online at http://borsoditranzit.hu/onritran/Doc/rimaszeki_majtenyi_dr_kekesi_ii_pdf at least as early as Nov. 25, 2013, 10 pages.

* cited by examiner

METAL REFINING PROCESS USING MIXED ELECTROLYTE

FIELD OF THE INVENTION

The present disclosure relates to an improved electrorefining process for producing high purity tin for use in the manufacture of semiconductor equipment and the like.

DESCRIPTION OF THE RELATED ART

Metallic materials, such as pure metals and metal alloys, for example, are typically used as solders in many electronic device packaging and other electronic manufacturing applications. It is well known that the emission of alpha particles from certain isotopes may lead to single-event upsets ("SEUs"), often referred to as soft errors or soft error upsets. Alpha particle emission (also referred to as alpha flux) can cause damage to packaged electronic devices, and more particularly, can cause soft error upsets and even electronic device failure in certain cases. Concerns regarding potential alpha particle emission heighten as electronic device sizes are reduced and alpha particle emitting metallic materials are located in closer proximity to potentially sensitive locations.

Initial research surrounding alpha particle emission from metallic materials focused on lead-based solders used in electronic device applications and consequent efforts to improve the purity of such lead-based solders. Of particular concern is the uranium-238 ($^{238}$U) decay chain, in which $^{238}$U decays to lead-210 ($^{210}$Pb), $^{210}$Pb decays to bismuth-210 ($^{210}$Bi), $^{210}$Bi decays to polonium-210 ($^{210}$Po) and $^{210}$Po decays to lead-206 ($^{206}$Pb) with release of a 5.304 MeV alpha particle. It is the last step of this decay chain, namely, the decay of $^{210}$Po to $^{206}$Pb with release of an alpha particle, which is considered to be the primary alpha particle emitter responsible for soft error upsets in electronic device applications.

More recently, there has been a transition to the use of non-lead or "lead free" metallic materials, such as silver, tin, copper, bismuth, aluminum, and nickel, for example, either as alloys or as pure elemental materials. However, even in substantially pure non-lead metallic materials, lead and/or polonium are typically present as impurities. Such materials may be refined to minimize the amount of impurities in the materials, but even very low levels (e.g., less than parts per trillion by mass) of impurities may be potentially problematic in the context of alpha particle emissions. Traditional refining processes may be able to remove polonium impurities, which are generally responsible for short-term alpha particle emissions. However, such refining processes may not be able to remove lead impurities, which are generally responsible for long-term alpha particle emissions.

SUMMARY OF THE INVENTION

The present disclosure provides an electrorefining process for producing high purity tin having reduced short-term and long-term alpha particle emissions and reduced lead levels. The process may use a mixed acidic electrolytic solution including at least a first electrolyte that provides sulfate ions in the mixed electrolytic solution, such as sulfuric acid, and a second electrolyte that provides halide ions in the mixed electrolytic solution, such as hydrochloric acid.

In one form thereof, the present disclosure provides a method for electrorefining tin. The method includes providing an acidic electrolytic solution including a first concentration of sulfate ions, a second concentration of halide ions, and a third concentration of stannous ions exceeding 50 g/L. The method also includes electrodepositing the stannous ions from the electrolytic solution onto a substrate to produce a refined tin.

In another form thereof, the present disclosure provides a method for electrorefining tin. The method includes providing an acidic electrolytic solution including a first concentration of sulfate ions, a second concentration of halide ions, wherein the first concentration of sulfate ions is at least about 50 times greater than the second concentration of halide ions, and a third concentration of stannous ions. The method also includes electrodepositing the stannous ions from the electrolytic solution onto a substrate to produce a refined tin.

In yet another form thereof, the present disclosure provides a method for electrorefining tin. The method includes providing an acidic electrolytic solution including a first concentration of sulfate ions, a second concentration of halide ions of about 100 ppm to about 1000 ppm, and a third concentration of stannous ions. The method also includes electrodepositing the stannous ions from the electrolytic solution onto a substrate to produce a refined tin.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

DETAILED DESCRIPTION

Figure 1:
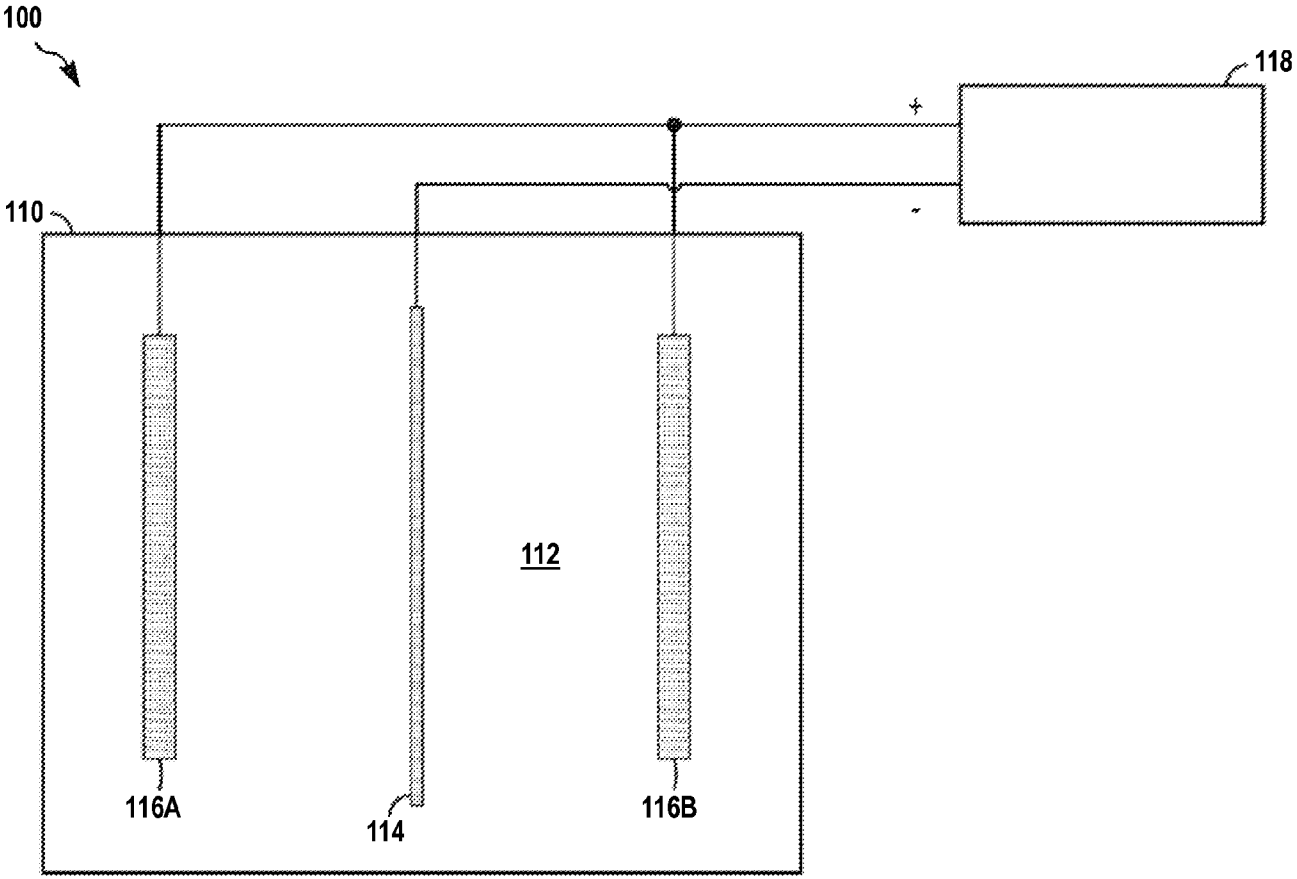
FIG. 1 illustrates a schematic tin electrorefining system of the present disclosure.

Referring to FIG. 1, an exemplary electrorefining system 100 is provided to produce refined tin having reduced short-term and long-term alpha particle emissions or alpha flux and reduced lead levels. The refined tin may exhibit short-term reduced alpha particle emissions immediately or soon after the electrorefining process, such as the same day as completing the electrorefining process or within 1, 2, or 3 days thereafter. The refined tin may exhibit long-term reduced alpha particle emissions over time, such as 30, 60, or 90 days after the electrorefining process. Long-term alpha particle emissions may also be referred to as "alpha drift."

System 100 of FIG. 1 includes a tank 110 that contains an electrolytic solution 112. One or more cathodes and one or more anodes are positioned in tank 110. The illustrative system 100 of FIG. 1 includes a first anode 116A and a second anode 116B positioned on either side of an intermediate cathode 114, but the number and arrangement of the cathodes and anodes in tank 110 may vary.

System 100 of FIG. 1 also includes a rectifier 118 that is connected to cathode 114 and anodes 116A, 116B to generate a desired current density therebetween. In certain embodiments, the current density at cathode 114 may be as low as about 10, 15, 20, 25, 30, or 35 A/ft$^2$ (ASF) or as great as about 40, 45, 50, 55, 60, 65 or 70 ASF, or within any range delimited by any pair of the foregoing values. In one particular embodiment, the current density at cathode 114 may be as low as about 16 ASF, 18 ASF, or 20 ASF or as great as about 22, 24, or 26 ASF, or within any range delimited by any pair of the foregoing values. For example, the current density may be about 20 ASF (22 mA/cm$^2$) at cathode 114, which may correspond to a current density of about 7-10 ASF (8-11 $mA/cm^2$) at anodes 116A, 116B. In another particular embodiment, the current density at cathode 114 may be as low as about 36 ASF, 38 ASF, or 40 ASF or as great as about 42, 44, or 46 ASF, or within any range delimited by any pair of the foregoing values. In still other embodiments, the current density at cathode 114 may be as low as about 75, 100, 125 or 150 ASF or as great as about 175, 200, 225, 250, 275 or 300 ASF or more, or within any range delimited by any pair of the foregoing values. The current density may be calculated by measuring the current (A) at an electrode and dividing by the electrode effective area (e.g., $ft^2$).

Referring still to FIG. 1, system 100 may be operated to electrodeposit or electrorefine tin. In embodiments where anodes 116A, 116B are made of tin, the tin may dissolve or leach from anodes 116A, 116B into electrolytic solution 112. In other embodiments, tin may be added to electrolytic solution 112 in other forms, such as from a metal powder or aqueous ions. The tin in electrolytic solution 112 may be referred to herein as the "starting tin." The starting tin may be commercially available tin having a purity level of about 99.0% to 99.999% (2N to 5N) and alpha particle emissions above about 0.001, 0.002, 0.005, 0.010, 0.015, or 0.020 counts/hour/$cm^2$ (cph/$cm^2$) or more, for example.

Under the applied current from rectifier 118, the starting tin in electrolytic solution 112 may deposit or plate onto cathode 114 while leaving behind alpha-emitting impurities in electrolytic solution 112. In this manner, cathode 114 may serve as a substrate for the plated tin. The impurities may be metallic impurities that are either capable of direct decay with concurrent release of an alpha particle, such as $^{210}Po$ impurities, or capable of producing intermediate decay products that subsequently decay with concurrent release of an alpha particle, such as $^{210}Pb$, $^{210}Bi$, or $^{238}U$ impurities that are capable of producing intermediate $^{210}Po$ impurities.

The tin that is deposited onto the substrate or cathode 114 may be referred to herein as the "refined tin." The refined tin may contain fewer impurities than the starting tin and have reduced short-term and long-term alpha particle emissions or alpha flux compared to the starting tin. The overall reduction in alpha particle emissions will vary depending on many factors including, but not limited to, the alpha particle emissions of starting tin. In certain embodiments, the short-term and/or long-term alpha particle emissions of the refined tin may be reduced by at least 50%, more particularly at least 75%, and even more particularly at least 85%, 90% or 95% compared to the alpha particle emissions of the starting tin. In other embodiments, the short-term and/or long-term alpha particle emissions of the refined tin may be less than about 0.010, 0.005, 0.002, or 0.001 cph/$cm^2$, for example. In certain embodiments, the reduced alpha particle emissions of the refined tin that are achieved in the short-term immediately or soon after the electrorefining process may be generally maintained over time, such as 30, 60, or 90 days after the electrorefining process.

Electrolytic solution 112 may be subjected to one or more optional purification processes to remove impurities and/or contaminant components left behind from the starting tin. This purification may occur continuously during the electrorefining process and/or after the electrorefining process. For example, electrolytic solution 112 may be directed through a filter and/or an ion exchange column. Such purification processes are disclosed in U.S. Patent Application Publication No. 2013/0341196 to Silinger et al., entitled "Refining Process for Producing Low Alpha Tin," the disclosure of which is expressly incorporated herein by reference in its entirety.

Electrolytic solution 112 may be a mixed acidic solution including at least a first electrolyte that provides sulfate ions in the mixed electrolytic solution 112 and a second electrolyte that provides halide ions in the mixed electrolytic solution 112. The mixed acidic electrolytic solution 112 may also include a solvent, such as deionized water, as well as the starting tin.

The first electrolyte in the mixed electrolytic solution 112 may be a sulfate-based acid or soluble salt that readily disassociates to produce sulfate ions in the mixed electrolytic solution 112. Suitable salts may include alkali metals (Group I) or alkaline earth metals (Group II). Exemplary first electrolytes include sulfuric acid ($H_2SO_4$), sodium sulfate ($Na_2SO_4$), and potassium sulfate ($K_2SO_4$), for example.

The second electrolyte in the mixed electrolytic solution 112 may be a halide-based acid or soluble salt that readily disassociates to produce halide ions in the mixed electrolytic solution 112. Suitable salts may include alkali metals (Group I) or alkaline earth metals (Group II). Exemplary halide ions include chloride ions ($Cl^-$), bromide ions ($Br^-$), and iodide ions ($I^-$), so exemplary second electrolytes may include hydrochloric acid (HCl), sodium chloride (NaCl), potassium chloride (KCl), sodium bromide (NaBr), potassium bromide (KBr), sodium iodide (NaI), and potassium iodide (KI), for example. Fluoride ions ($F^-$) may not have the same effect as chloride, bromide, and iodide ions (See Example 3 below).

According to an exemplary embodiment of the present disclosure, the first electrolyte includes a sulfate-based acid or salt, such as sulfuric acid, and the second electrolyte includes a chloride-based acid or salt, such as hydrochloric acid.

The first electrolyte in the mixed electrolytic solution 112 may target and react primarily with a first impurity in the starting tin, and the second electrolyte in the mixed electrolytic solution 112 may target and react primarily with a second impurity in the starting tin. Without wishing to be bound by theory, the present inventors believe that sulfate ions from the first electrolyte may react primarily with polonium impurities in the starting tin, and that halide ions from the second electrolyte may react primarily with lead impurities in the starting tin. As a result, the refined tin may contain fewer polonium impurities and lead impurities than the starting tin.

The polonium content of the refined tin may be reduced by at least 40% or 50%, more particularly at least 60% or 70%, and even more particularly at least 80%, 90%, or 95% compared to the polonium content of the starting tin. In certain embodiments, the polonium content of the refined tin may be less than about 25, 50, or 100 atoms/$cm^3$ or less than about 1000, 2000, or 3000 atoms/$cm^3$, or within any range delimited by any pair of the foregoing values. By reducing the polonium content of the refined tin, the refined tin may exhibit reduced short-term (e.g., 0 day) alpha particle emissions.

Also, the lead content of the refined tin may be reduced by at least 40% or 50%, more particularly at least 60% or 70%, and even more particularly at least 80%, 90%, or 95% compared to the lead content of the starting tin. In certain embodiments, the lead content of the refined tin may be less than about 0.1, 0.3, or 0.5 ppm or less than about 1, 3, or 5 ppm, or within any range delimited by any pair of the foregoing values. For example, the lead content of the refined tin may be about 1 ppm or less. By reducing the lead content of the refined tin, the refined tin may exhibit reduced long-term (e.g., 30, 60, or 90 day) alpha particle emissions.

The concentration of the sulfate ions from the first electrolyte in the mixed electrolytic solution 112 may significantly exceed the concentration of the halide ions from the second electrolyte in the mixed electrolytic solution 112. For example, the sulfate ion concentration in the mixed electrolytic solution 112 may be at least about 50 or 100 times greater than the halide ion concentration in the mixed electrolytic solution 112.

The sulfate ion concentration in the mixed electrolytic solution 112 may be as low as about 20, 30, 40, 50, or 60 g/L or as high as about 70, 80, 90, 100, 110, or 120 g/L or more, or within any range delimited by any pair of the foregoing values. In certain embodiments, the sulfate ion concentration may be as low as about 50, 52, 54, 56, 58, 60, or 62 g/L or as high as about 64, 66, 68, 70, 72, 74, or 76 g/L, or within any range delimited by any pair of the foregoing values. For example, the sulfate ion concentration may be about 54 g/L to about 72 g/L.

The halide ion concentration in the mixed electrolytic solution 112 may be as low as about 0.1 g/L (100 ppm), 0.25 g/L (250 ppm), or 0.5 g/L (500 ppm) or as high as about 0.75 g/L (750 ppm), 1.0 g/L (1000 ppm), 1.25 g/L (1250 ppm), or 1.5 g/L (1500 ppm), or within any range delimited by any pair of the foregoing values. In particular embodiments, the halide ion concentration may be about 100 ppm to about 1000 ppm, more specifically about 250 ppm to about 1000 ppm, or more specifically about 500 ppm to about 1000 ppm. For example, the halide ion concentration may be about 750 ppm.

As discussed above, the second electrolyte in the mixed electrolytic solution 112 may be hydrochloric acid to produce chloride ions. In practice, the use of hydrochloric acid electrolytes may negatively impact the tin electrorefining process, such as by making the refined tin deposits dendritic in nature and difficult to harvest. Advantageously, the hydrochloric acid concentrations used herein may be low enough to avoid the difficulties associated with traditional hydrochloric acid electrolytes but high enough to still target lead impurities in the starting tin.

The concentration of tin or stannous ions in the mixed electrolytic solution 112 may be controlled to optimize the electrorefining process. The stannous ion concentration in the mixed electrolytic solution 112 may exceed about 50 g/L. The stannous ion concentration may be as low as about 55, 60, 65, 70, 75, 80, 85, 90, 95, or 100 g/L or as high as about 105, 110, 115, 120, 125, 130, 135, 140, 145, 150, or 155 g/L or more, or within any range delimited by any pair of the foregoing values. In one particular embodiment, the stannous ion concentration may be as low as about 90, 92, 94, 96, 98, or 100 g/L or as high as about 102, 104, 106, 108, or 110 g/L or more, or within any range delimited by any pair of the foregoing values. For example, the stannous ion concentration in the mixed electrolytic solution 112 may be about 100 g/L. At low stannous ion concentrations, such as 40, 30, or 20 g/L or less, the alpha particle emissions of the refined tin may be more sensitive to the current density of the electrorefining process than at higher stannous ion concentrations.

The pH of the mixed electrolytic solution 112 may also be controlled to optimize the electrorefining process. The mixed electrolytic solution 112 may have a low, or acidic, pH of less than 7. For example, the mixed electrolytic solution 112 may have a pH of less than about 6, less than about 5, less than about 4, less than about 3, less than about 2, or less than about 1. The acidic pH may promote dissolution of stannous ions into the mixed electrolytic solution 112. In certain embodiments, the first sulfate-based electrolyte will contribute protons to generate an acidic pH in the mixed electrolytic solution 112. For example, the first sulfate-based electrolyte may include sulfuric acid that generates the acidic pH. In other embodiments, the second chloride-based electrolyte and/or an auxiliary acid may generate the acidic pH.

The mixed electrolytic solution 112 may also include one or more optional additives. As used herein, an "additive" refers to a component of the mixed electrolytic solution 112 other than the mixed first and second electrolytes, the solvent, the starting tin, and impurities from the starting tin. The additive may be helpful for controlling one or more properties of the mixed electrolytic solution 112, the electrorefining process, and/or the refined tin product. The concentration of each additive in the mixed electrolytic solution 112 may be as low as about 0.05, 0.1, 0.5, 1, or 5 volume percent or as high as about 10, 15, or 20 volume percent or more, or within any range delimited by any pair of the foregoing values.

A suitable additive includes an antioxidant, which may be added to the mixed electrolytic solution 112 to prevent spontaneous $Sn^{2+}$ to $Sn^{4+}$ oxidation during electrolysis. Suitable antioxidants include, but are not limited to, phenyl-sulfonic acid and hydroquinone. Suitable commercially available antioxidants include Technistan Antioxidant, Techni Antioxidant Number 8 available from Technic, and Solderon BP Antioxidant available from Dow Chemical.

Another suitable additive includes an organic grain refiner, which may be added to the mixed electrolytic solution 112 to limit dendritic deposition at cathode 114. A suitable organic grain refiner includes, but is not limited to, polyethylene glycol. Suitable commercially available organic grain refiners include Technistan TP-5000 Additive, Techni Matte 89-TI available from Technic, and Solderon BP Primary available from Dow Chemical.

In certain embodiments, two or more electrorefining processes may be performed. Each electrorefining process may use the same or different electrolytic solutions. For example, each electrorefining process may use electrolytic solutions having the same or different first and second electrolytes, additives, and/or pH levels. These electrorefining processes may be conducted in series or in succession such that stannous ions are electrodeposited two or more times. For example, a first electrorefining process may be performed to deposit tin from a first electrolytic solution, the deposited tin may be dissolved into a second electrolytic solution, and then a second electrorefining process may be performed to deposit tin from the second electrolytic solution. Impurities and/or contaminant components may be removed in each successive electrorefining process.

Alpha particle emissions of the starting tin and/or the refined tin may be measured at different times using commercially available alpha detectors. Suitable commercially available detectors include Alpha Sciences' 1950 Gas Flow Proportional Counter and XIA's UltraLo-1800 Alpha Particle Counter. It is also within the scope of the present disclosure to predict the alpha particle emission of the tin over a period of time as described in U.S. Patent Application Publication No. 2013/0292579 to Clark, entitled "Method for Assessing an Alpha Particle Emission Potential of a Metallic Material," the disclosure of which is expressly incorporated herein by reference in its entirety.

Trace element levels in the starting tin and/or the refined tin may be measured using a spectrometer, such as an Inductive Coupled Plasma—Atomic Emission Spectrometer (ICP-AES) or a Glow Discharge Mass Spectrometer (GDMS). A suitable commercially available spectrometer is Varian's Vista Pro ICP-AES.

EXAMPLES

The following non-limiting examples illustrate various features and characteristics of the present invention, which is not to be construed as limited thereto.

Example 1

Tin Electrorefininq with Mixed Sulfuric Acid and Hydrochloric Acid Electrolytic Solution An experiment was performed to evaluate mixed electrolytic solutions including both sulfuric acid and hydrochloric acid. The electrolytic solution included 3 volume percent sulfuric acid in deionized water. The starting tin was electrolytically dissolved into the sulfuric acid electrolyte from high purity tin anodes. Two additives—an antioxidant and an organic grain refiner—were also added to the electrolytic solution. The antioxidant, specifically Technistan Antioxidant, had a concentration of 1 percent by volume in the electrolytic solution. The organic grain refiner, specifically Technistan TP-5000, had a concentration of 4 percent by volume in the electrolytic solution.

The electrolysis system included a 30 L polypropylene tank equipped with a vertical pump for solution agitation and filtration. The system also included a central titanium cathode, two tin anodes arranged on either side of the cathode, and a DC power supply connected to the cathode and anodes. Electrolysis was performed at room temperature.

The electrorefining parameters that were varied in this experiment include: the chloride ion ($Cl^-$) concentration in the electrolytic solution (500 ppm or 1000 ppm); the stannous ion ($Sn^{2+}$) concentration in the electrolytic solution (50 g/L or 100 g/L); the cathode current density (CD) (20 ASF or 40 ASF); the alpha particle emissions of the starting tin (0.002 cph/cm$^2$ or 0.024 cph/cm$^2$); and the lead (Pb) content of the starting tin (3 ppm or 9 ppm). These electrorefining parameters are set forth in Table 1 below.

TABLE 1

| | | | | Starting Tin | | Refined Tin | | Change | |
|---|---|---|---|---|---|---|---|---|---|
| Sample | CI (ppm) | Sn (g/L) | CD (ASF) | Alpha (cph/cm$^2$) | Pb (ppm) | Alpha (cph/cm$^2$) | Pb (ppm) | Alpha (%) | Pb (%) |
| 1 | 500 | 50 | 20 | 0.024 | 9 | 0.00232 | 9 | −90% | — |
| 2 | 500 | 50 | 40 | 0.002 | 3 | 0.00131 | 4 | −35% | +33% |
| 3 | 500 | 100 | 20 | 0.002 | 3 | 0.00250 | <0.5 | +25% | >−83% |
| 4 | 500 | 100 | 40 | 0.024 | 9 | 0.00188 | 10 | −92% | +11% |
| 5 | 1000 | 50 | 20 | 0.002 | 3 | 0.00107 | 4 | −47% | +33% |
| 6 | 1000 | 50 | 40 | 0.024 | 9 | 0.00149 | 7 | −94% | −22% |
| 7 | 1000 | 100 | 20 | 0.024 | 9 | 0.00188 | 5 | −92% | −44% |
| 8 | 1000 | 100 | 40 | 0.002 | 3 | 0.00156 | 4 | −22% | +33% |
| 9 | 500 | 50 | 20 | 0.024 | 9 | 0.00223 | 9 | −91% | — |
| 10 | 500 | 50 | 40 | 0.002 | 3 | 0.00129 | 4 | −36% | +33% |
| 11 | 500 | 100 | 20 | 0.002 | 3 | 0.00218 | <0.5 | +9% | >−83% |
| 12 | 500 | 100 | 40 | 0.024 | 9 | 0.00339 | 20 | −86% | +122% |
| 13A | 1000 | 50 | 20 | 0.002 | 3 | 0.00110 | 4 | −45% | +33% |
| 13B | 1000 | 50 | 20 | 0.002 | 3 | 0.00116 | 4 | −42% | +33% |
| 14 | 1000 | 50 | 40 | 0.024 | 9 | 0.00454 | 10 | −81% | +11% |
| 15 | 1000 | 100 | 20 | 0.024 | 9 | 0.00235 | 6 | −90% | −33% |
| 16 | 1000 | 100 | 40 | 0.002 | 3 | 0.00117 | 4 | −42% | +33% |

When the cathode current density was 20 ASF, electrolysis was performed for 48 hours. When the cathode current density was 40 ASF, electrolysis was performed for 24 hours.

After electrorefining, the refined tin was harvested from the cathodes and cast to produce refined tin samples. The refined tin samples were analyzed for alpha particle emissions immediately after casting using Alpha Sciences' 1950 Gas Flow Proportional Counter and for trace elements using Varian's Vista Pro ICP-AES. The results are presented in Table 1 above.

In the present Example 1, the lead content of several refined tin samples decreased relative to the starting tin (Samples 3, 6, 7, 11, and 15). Therefore, by adding hydrochloric acid to the sulfuric acid electrolyte, the present inventors were able to achieve lead removal. The most significant levels of lead removal (83% or more) were observed when the stannous ion concentration in the electrolytic solution was 100 g/L and the current density was 20 ASF (Samples 3 and 11).

Certain refined tin samples exhibited increased alpha particle emissions and/or increased lead contents compared to the starting tin. These increases may have been caused by variability in the purity of the starting tin anodes. The alpha particle emissions and lead contents presented in Table 1 represent average values for each starting tin anode, but the actual alpha particle emissions and lead contents may vary across the volume of each starting tin anode. For example, if an outer region of a starting tin anode is more pure than an inner region of the starting tin anode, refined tin samples created from the outer region of the starting tin anode may be more pure than refined tin samples created from the inner region of the starting tin anode. Also, these increases may have been caused by variability in the purity of the electrolytic solution over the duration of the experiment. For example, as more and more lead impurities accumulate in the electrolytic solution before the electrolytic solution is regenerated or replaced, the electrolytic solution may become saturated with lead and incapable of capturing more lead from the starting tin anodes.

Example 2

Evaluation of Chloride Concentration in a Mixed Sulfuric Acid and Hydrochloric Acid Electrolytic Solution Another experiment was performed to evaluate mixed electrolytic solutions including both sulfuric acid and hydrochloric acid. Based on Example 1 above, this experiment focused on stannous ion concentrations of 100 g/L and current densities of 20 ASF, because the most significant levels of lead removal were achieved with these conditions. The electrorefining parameter that was varied in this experiment was the chloride ($Cl^-$) concentration in the electrolytic solution (250 ppm, 500 ppm, 750 ppm, 1000 ppm, 100,000 ppm, or 500,000 ppm). The electrorefining parameters are shown in Table 2 below.

TABLE 2

| Sample | Cl (ppm) | Sn (g/L) | CD (ASF) | Starting Pb (ppm) | Refined Pb (ppm) | Pb Change (%) | Average (%) |
|---|---|---|---|---|---|---|---|
| 17A | 500 | 100 | 20 | 9 | 0.22 | −97.6% | −95.0% |
| 17B | 500 | 100 | 20 | 9 | 0.68 | −92.4% | |
| 18A | 1000 | 100 | 20 | 9 | 0.36 | −96.0% | −94.4% |
| 18B | 1000 | 100 | 20 | 9 | 0.46 | −94.9% | |
| 19A | 1000 | 100 | 40 | 9 | 0.29 | −96.8% | |
| 19B | 1000 | 100 | 40 | 9 | 0.90 | −90.0% | |
| 20A | 250 | 100 | 20 | 9 | 0.49 | −94.6% | −92.5% |
| 20B | 250 | 100 | 20 | 9 | 0.86 | −90.4% | |
| 21A | 750 | 100 | 20 | 9 | 0.21 | −97.7% | −96.5% |
| 21B | 750 | 100 | 20 | 9 | 0.42 | −95.3% | |
| 22A | 100,000 | 100 | 20 | 9 | 0.43 | −95.2% | −93.7% |
| 22B | 100,000 | 100 | 20 | 9 | 0.70 | −92.2% | |
| 23A | 500,000 | 100 | 20 | 9 | 0.95 | −89.4% | −89.6% |
| 23B | 500,000 | 100 | 20 | 9 | 0.92 | −89.8% | |

The chloride concentration in the electrolytic solution impacted the quality of the refined tin deposits on the cathodes. When the chloride concentration in the electrolytic solution was relatively low, such as 250 ppm (Samples 20A-20B), 500 ppm (Samples 17A-17B), or 750 ppm (Samples 21A-21B), the refined tin deposits were smooth and uniform. However, when the chloride concentration in the electrolytic solution was relatively high, such as 1000 ppm and above (Samples 18A-19B and 22A-23B), the refined tin deposits became increasingly dendritic in nature and increasingly difficult to harvest.

After electrorefining, the refined tin was harvested from the cathodes and cast to produce refined tin samples. The refined tin samples were analyzed for trace elements using GDMS. The lead content results are presented in Table 2 above and in FIG. 2. Although not shown in Table 2, the bismuth content of each refined tin sample was also analyzed, and all of the samples had bismuth contents of 0.001 ppm.

Figure 2:
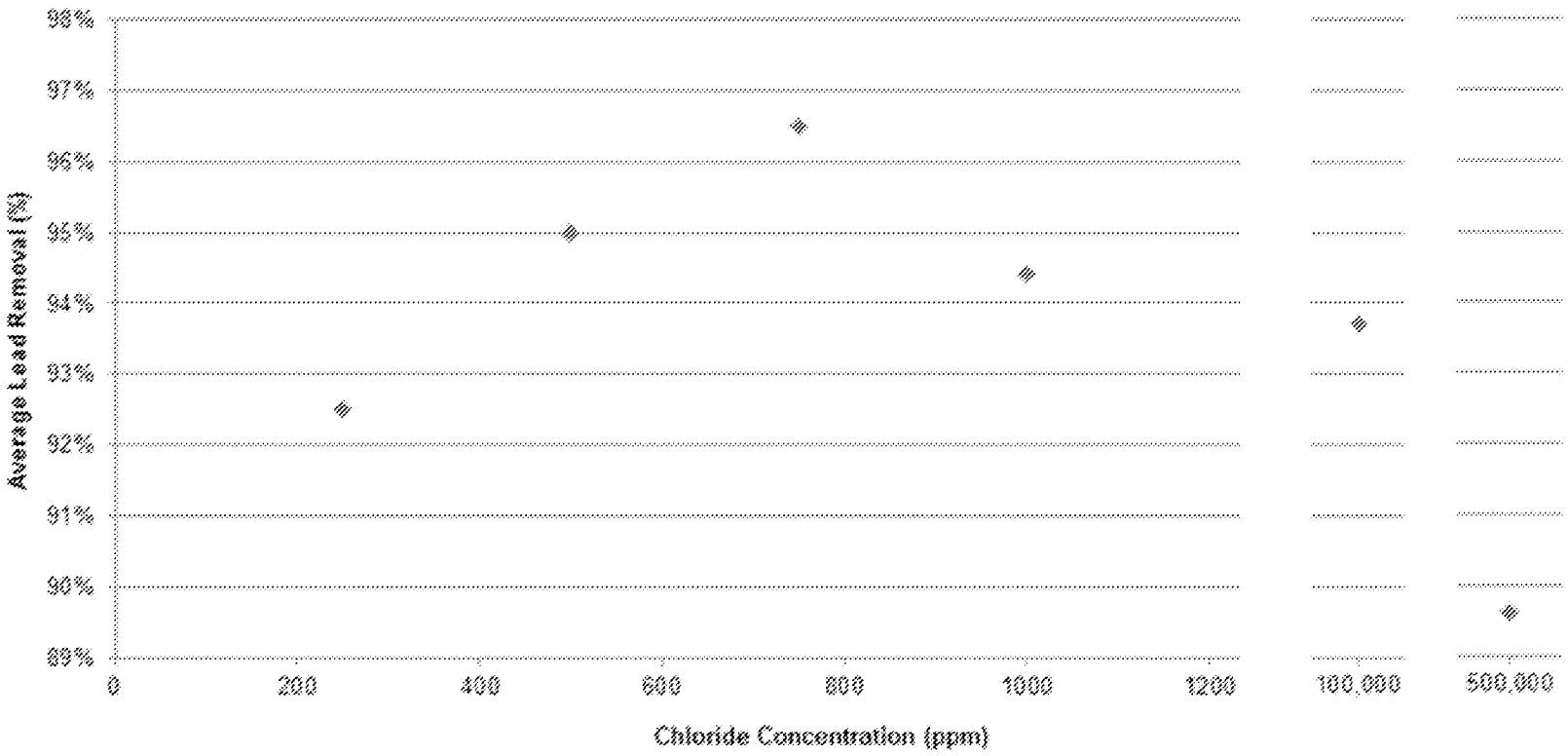
FIG. 2 is a chart showing experimental data for average lead removal versus chloride concentration in the electrolytic solution.

In all of the refined tin samples, the lead content of the refined tin decreased compared to the starting tin. Therefore, by adding hydrochloric acid to the sulfuric acid electrolyte, the present inventors were able to achieve lead removal. As shown in FIG. 2, the most significant lead removal (96.5% average) was achieved when the chloride concentration in the electrolytic solution was 750 ppm (Samples 21A-21B).

The chloride concentration in the electrolytic solution impacted lead removal. Surprisingly, as shown in FIG. 2, the lead removal eventually decreased as the chloride concentration increased, especially as the chloride concentration increased above 1000 ppm (Samples 22A-23B). Therefore, beyond a certain threshold (e.g., beyond about 1000 ppm), adding additional hydrochloric acid to the electrolytic solution may actually hinder lead removal. As discussed above, adding additional hydrochloric acid to the electrolytic solution may also negatively impact the quality of the refined tin deposits. Therefore, both the quality of the refined tin deposits and the lead removal may be optimized by maintaining the chloride concentration at or below the threshold (e.g., at or below about 1000 ppm, such as about 750 ppm).

Example 3

Evaluation of Mixed Sulfuric Acid Electrolytic Solutions with Other Halides

Another experiment was performed to evaluate mixed electrolytic solutions including sulfuric acid and halides other than chloride, specifically fluoride, iodide, and bromide. The halide concentration in each electrolytic solution was 500 ppm. The other electrorefining parameters were consistent with Example 2 above.

TABLE 3

| Sample | Halide | Starting Pb (ppm) | Refined Pb (ppm) | Pb Change (%) | Average (%) |
|---|---|---|---|---|---|
| 24A | F | 9 | 20 | +122.2% | |
| 24B | F | 9 | 9 | — | +37.0% |
| 24C | F | 9 | 8 | −11.1% | |
| 25A | I | 9 | <0.5 | >−94.4% | |
| 25B | I | 9 | <0.5 | >−94.4% | >−94.4% |
| 25C | I | 9 | <0.5 | >−94.4% | |
| 26A | Br | 9 | <0.5 | >−94.4% | |
| 26B | Br | 9 | <0.5 | >−94.4% | >−94.4% |
| 26C | Br | 9 | <0.5 | >−94.4% | |

After electrorefining, the refined tin was harvested from the cathodes and cast to produce refined tin samples. The refined tin samples were analyzed for trace elements using Varian's Vista Pro ICP-AES. The lead content results are presented in Table 3 above. Although not shown in Table 3, the bismuth content of each refined tin sample was also analyzed, and all of the samples had bismuth contents of less than 0.3 ppm.

When iodide (Samples 25A-25C) and bromide (Samples 26A-26C) were used as halides, the lead content of every refined tin sample decreased relative to the starting tin. However, when fluoride (Samples 24A-24C) was used as the halide, the lead content of the refined tin samples actually increased, on average, relative to the starting tin.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for electrorefining tin, the method comprising:
providing an acidic electrolytic solution comprising:
a first concentration of sulfate ions;
a second concentration of halide ions of about 100 ppm to about 1000 ppm; and
a third concentration of stannous ions, wherein the third concentration of stannous ions exceeds 50 g/L; and
electrodepositing the stannous ions from the electrolytic solution onto a substrate to produce a refined tin.

2. The method of claim 1, wherein the third concentration of stannous ions is about 55 g/L to about 75 g/L.

3. The method of claim 2, wherein the third concentration of stannous ions is about 60 g/L to about 70 g/L.

4. The method of claim 1, wherein the first concentration of sulfate ions is about 54 g/L to about 72 g/L.

5. The method of claim 1, wherein the second concentration of halide ions is about 500 ppm to about 1000 ppm.

6. The method of claim 1, wherein the electrodepositing step is performed with a current density of about 10 $A/ft^2$ to about 70 $A/ft^2$ at the substrate.

7. The method of claim 1, wherein the refined tin that is electrodeposited onto the substrate has a lead content of less than about 1 ppm.

8. The method of claim 1, wherein the refined tin that is electrodeposited onto the substrate has alpha particle emissions of less than about 0.001 counts/hour/$cm^2$ measured at least one of 0, 30, 60, or 90 days after the electrodepositing step.

9. The method of claim 1, wherein the first concentration of sulfate ions is at least about 50 times greater than the second concentration of halide ions.

10. The method of claim 1, wherein the halide ions are selected from the group consisting of chloride, bromide, and iodide.

* * * * *